US006209925B1

(12) United States Patent
Edin

(10) Patent No.: US 6,209,925 B1
(45) Date of Patent: Apr. 3, 2001

(54) TURN SHAFT FOR A VACUUM CLEANER

(75) Inventor: Anders Edin, Järfälla (SE)

(73) Assignee: Aktiebolaget Electrolux, Stockholm (SE)

( * ) Notice: Subject to any disclaimer, the term of this patent is extended or adjusted under 35 U.S.C. 154(b) by 0 days.

(21) Appl. No.: 09/251,505

(22) Filed: Feb. 17, 1999

(30) Foreign Application Priority Data

Mar. 12, 1998 (SE) ..... 9800800

(51) Int. Cl.[7] ..... F16L 27/08

(52) U.S. Cl. ..... 285/7; 285/181; 285/272; 15/411

(58) Field of Search ..... 285/7, 181, 272; 15/411, 414

(56) References Cited

U.S. PATENT DOCUMENTS

| | | | | |
|---|---|---|---|---|
| 981,705 | * | 1/1911 | Spencer | 285/7 |
| 981,893 | * | 1/1911 | Spencer | 285/7 |
| 1,012,195 | | 12/1911 | English . | |
| 1,086,367 | * | 2/1914 | Hope | 285/7 |
| 1,104,148 | | 7/1914 | Spencer . | |
| 1,838,481 | * | 12/1931 | Gudka | 15/411 |
| 2,245,151 | * | 6/1941 | Martinet | 285/7 |
| 3,565,464 | * | 2/1971 | Wolf | 285/7 |
| 3,633,942 | | 1/1972 | Meyerhoefer . | |

* cited by examiner

*Primary Examiner*—Eric K. Nicholson
(74) *Attorney, Agent, or Firm*—Pearne & Gordon LLP

(57) ABSTRACT

A tube shaft for a vacuum cleaner the shaft (10) having an upper tube part (15) and a lower tube part turnably connected to one another and each including at least two tube sections (15*c*,15*e*,16*b*,16*c*). The tube sections of each tube part are inclined with respect to one another. The lower tube part (16) includes an end section (16*b*) supporting a nozzle (14), the nozzle having a nozzle part (14*a*) and a connecting part (14*b*). The connecting part is connected to the end section of the lower tube part whereas an upper end (15*f*) of the upper tube part (15) is connected to a hose, a tube handle (11) or the like. The lower tube part (16) is arranged to be turned about 180° with respect to the upper tube part (15) as well as to the nozzle part (14*a*) from a first turning position, wherein said end section (16*b*) is inclined a first angle (α) with respect to the floor, to a second turning position, wherein the end section (16*b*) is inclined a second, relatively smaller angle (β) with respect to the floor.

12 Claims, 1 Drawing Sheet

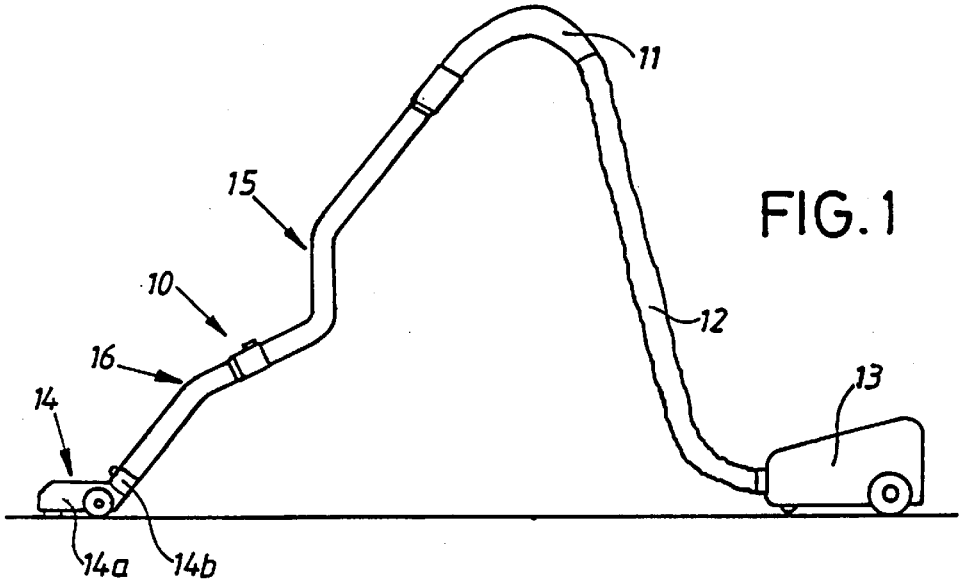
FIG. 1
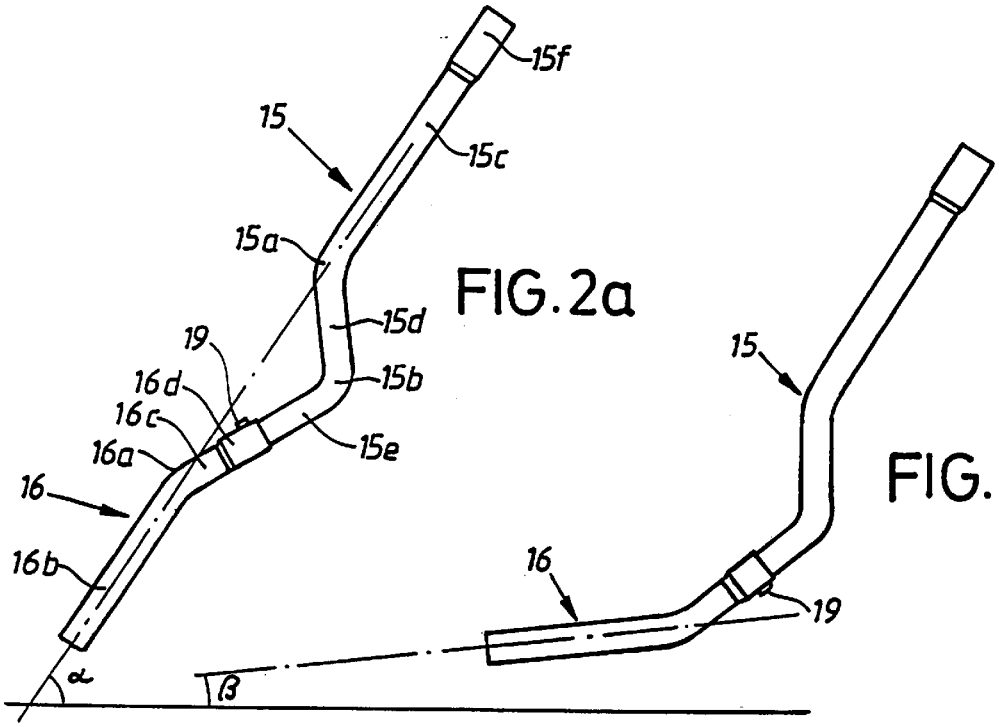
FIG. 2a
FIG. 2b
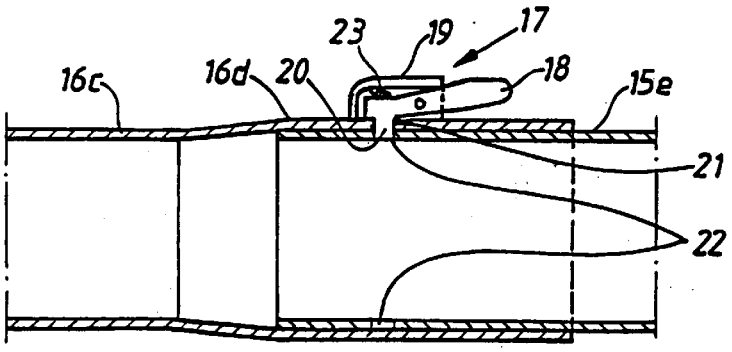
FIG. 3

TURN SHAFT FOR A VACUUM CLEANER

BACKGROUND OF THE INVENTION

The present invention relates to a vacuum cleaner tube shaft having an upper tube part and a lower tube part that are turnably connected to one another, wherein each tube part has two tube sections that are inclined with respect to one another, the lower tube part has an end section supporting a nozzle that includes a nozzle part and a connecting part, the connecting part being connected to the end section while the upper end of the upper tube part is connected to a hose, a tube handle or the like.

Tube shafts of different types are previously known. The simplest tube shafts have one or more hollow, straight sections to which a tube handle with a hose and a nozzle is connected. The hose is further connected to a vacuum source arranged in a vacuum cleaner housing or to a suction port for a so-called central vacuum system.

A problem when using such tube shafts is that it is difficult to reach sufficiently far beneath low furniture and other details. Thus, the operator is forced to bend in order to decrease the angle between the tube shaft and the floor surface. This is, of course, uncomfortable and cumbersome.

In order to reduce this problem it has previously been suggested, see WO 89/07412, to use a flexible hose between two sections of the tube shaft, with a lower section of the tube shaft being adjustable to a position parallel to the floor surface. However, this arrangement is very primitive and it is difficult to operate the tube shaft in its normal position because of the flexibility of the hose.

A similar arrangement, but with additional elements to stabilize the two sections with respect to one another is also previously known, see SE 9600650. This arrangement is, however, very complicated because the existence of several ball joints, telescopically arranged components, and additional tube sections.

It is also previously known, see JP 725653, to manufacture the complete tube shaft, or a portion thereof, is made from flexible material, which means that the tube shaft is bent under the influence of the contact forces with the furniture. Even if such a design is appealing in the abstract, it is difficult to find material compositions that simultaneously provide the necessary flexibility and stability during normal use.

Moreover, U.S. Pat. No. 1,012,195 and U.S. Pat. No. 1,104,148 describe other types of arrangements for facilitating cleaning operations below furniture. U.S. Pat. No. 1,012,195 describes a tube shaft comprising two parts, a lower straight part and an upper handle part having a short air inlet section which is inclined with respect to an elongated air outlet section. When cleaning below furniture the upper part is turned 180°. This, however, means that the handle part has to be moved to a position near the floor which is as uncomfortable as when using ordinary tube shafts. U.S. Pat. No. 1,104,148 describes an arrangement having a bent tube shaft that can be turned 90° at each side of a central upraised position. However, when turning the tube shaft to one of its side positions the operator is forced to move the handle part towards the floor in order to reach under furniture. Consequently this arrangement has the same disadvantages as the arrangement described in U.S. Pat. No. 1,012,195.

SUMMARY OF THE INVENTION

The present invention is directed toward a simple and cheap arrangement making it possible to adjust the tube shaft between a normal position and a position in which cleaning below low furniture is facilitated. The present invention is further directed toward such an arrangement wherein the stability of the tube shaft is not reduced by the existence of a flexible element or a flexible material.

BRIEF DESCRIPTION OF THE DRAWINGS

These and further features of the present invention will be apparent with reference to the following description and drawings, wherein:

FIG. 1 schematically shows a side view of a vacuum cleaner being equipped with a tube shaft according to the invention;

FIG. 2*a* shows, in an enlarged scale, the tube shaft in a first normal position;

FIG. 2*b* shows, in an enlarged scale, the tube shaft in a second position to be used when cleaning below low surfaces; and, FIG. 3 shows a section through the tube shaft at the connection between the parts of the tube shaft.

DETAILED DESCRIPTION OF THE PREFERRED EMBODIMENT

FIG. 1 shows a vacuum cleaner having a tube shaft 10 which, via a tube handle 11 and a hose 12, is connected to a vacuum cleaner housing 13. The vacuum cleaner housing 13, in a traditional way, encloses an electrically driven fan unit (not shown) and a dust container (not shown) in which the dust is collected. Alternatively, the hose 12 can be connected to an outlet port of a central vacuum cleaner system.

The lower end of the tube shaft 10 supports a conventional nozzle 14 having a nozzle part 14*a* to which a connecting part 14*b* is turnably and tiltably secured. The tube shaft 10 comprises an upper tube part 15 and a lower tube part 16 both being made of stiff material, such as hard plastic or aluminum.

The upper tube part 15 comprises a first bent segment 15*a* and an oppositely-directed second bent segment 15*b*. The first and second bent segments 15*a*, 15*b* separate three mainly straight sections that are inclined with respect to one another, the mainly straight sections being an upper section 15*c*, a middle section 15*d*, and a lower section 15*e*. The upper section 15*c* is, at its upper end, provided with a sleeve 15*f* in which the tube handle 11 in a traditional way is inserted and secured.

The lower tube part 16 comprises a bent segment 16*a* separating two straight sections, a lower end section 16*b* and an upper section 16*c*, which are inclined with respect to one another. The upper section 16*c* is provided with a sleeve 16*d* in which the lower section 15*e* of the upper tube part 15 can be inserted and locked by means of a locking mechanism.

With reference to FIG. 3, the locking mechanism includes a rocker arm 18 turnably or pivotally secured in a holder 19 that is fixed to the sleeve 16*d*. The rocker arm 18 has an extending part or finger 20 extending through an opening 21 in the sleeve 16*d* as well as through one of two diametrically opposed openings 22 formed in the lower section 15*e* of the upper tube part 15. The outer portion or surface of the extending part 20 is slanted and the rocker arm is under the influence of a spring 23 that biases the extending part 20 toward the opening 21 in the sleeve 16*d*.

Accordingly, as the lower section 15*e* of the upper tube part 15 is axially inserted into the sleeve 16*d*, the rocker arm 18 pivots against the spring bias and the slanted surface of the extending part 20 of the rocker arm 18 slides along the outer surface of the lower section 15*e*. When the lower section 15*e* is completely inserted into the sleeve 16*d*, the rocker arm 18 pivots, due to the spring bias, such that the extending part 20 is inserted through the opening 22 in the lower section 15*e* and snap-locks the upper tube part 15 to the lower tube part 16. It is contemplated that an identical locking arrangement be used between the nozzle connecting part 14*b* and the lower tube part end section 16*b*.

Also, with the above-described locking mechanism, the tube parts 15, 16 can be easily reconfigured from a first position (FIG. 2*a*) to a second position (FIG. 2*b*) by simply disengaging the locking mechanism from one of the openings 22, rotating the lower tube part 16, and re-engaging the locking mechanism with the other of the openings 22.

Thus, the arrangement is designed such that the lower tube part 16, with its end section 16*b*, can be turned 180° about a central axis extending in the length direction of the end section 16*b*, and the connecting part 14*b* together with the tube shaft 10 can be tilted about a horizontal axis which is perpendicular to the central axis.

The device according to the present invention operates and is used in the following manner. During normal vacuum cleaning operation (FIG. 2*a*), the upper tube part 15 is inserted into and is locked in the lower tube part 16 such that the upper section 15*c* is mainly in line with the end section 16*b* at a first angle a with respect to the floor. The nozzle 14 is, by means of the connecting part 14*b*, secured to the end section 16*b*. Vacuum cleaning operation can now be undertaken in a traditional way.

In order to adjust the arrangement for cleaning under furniture (FIG. 2*b*), the rocker arm 18 is depressed to release the locking mechanism and permit the tube parts 15, 16 to be turned relative to one another about a common axis of the two tube sections 15*e* and 16*c*. When the lower tube part 16 has been turned about 180° with respect to the upper tube part 15, these parts 15, 16 are fixed to one another because the extending part 20 of the rocker arm 18 snaps into the other of the openings 22. Then the nozzle part 14*a* is likewise turned 180° with respect to the end section 16*b*. This means that the end section 16*b* forms a second angle β with respect to the floor, wherein the second angle β is less than the first angle α. Because of the new configuration of the tube shaft it is now possible to move the nozzle 14 under low furniture generally without lowering the tube handle 11. It is noted that the upper section 15*c* generally remains at the convenient first angle a with respect to the floor.

It should be mentioned that it of course is possible to use several tube parts to vary the shape of the tube shaft in a suitable manner in order to get the intended result as well as to use different types of locking arrangements between the tube parts and/or the nozzle.

While the preferred embodiment of the present invention is shown and described herein, it is to be understood that the same is not so limited but shall cover and include any and all modifications thereof which fall within the purview of the invention.

What is claimed is:

1. A tube shaft for a vacuum cleaner, said shaft (10) comprising an upper tube part (15) and a lower tube part (16) turnably connected to one another, each tube part comprising at least two tube sections (15*c*, 15*e*, 16*b*, 16*c*) that are inclined with respect to one another, the lower tube part (16) being provided with an end section (16*b*) supporting a nozzle (14) that is provided with a nozzle part (14*a*) to which a connecting part (14*b*) is tiltably secured, the connecting part of the nozzle being connected to the lower tube part end section, wherein the lower tube part (16) when the nozzle is kept in an operating position is arranged to be turned about 180° relative to the upper tube part (15) from a first turning position in which said end section (16*b*) is inclined a first angle (α) with respect to the floor to a second turning position in which the end section (16*b*) is inclined a second angle (β) with respect to the floor, said second angle being less than said first angle.

2. A tube shaft according to claim 1, wherein the nozzle part (14*a*) is also arranged to be turned about 180° relative to the lower tube part (16).

3. A tube shaft according to claim 1, wherein the tube sections are generally straight and are connected to one another by at least one tubular bent segment (15*a*,15*b*,16*a*).

4. A tube shaft for a vacuum cleaner, said shaft (10) comprising an upper tube part (15) and a lower tube part (16) turnably connected to one another, each tube part comprising at least two tube sections (15*c*, 15*e*, 16*b*, 16*c*) that are inclined with respect to one another the lower tube part (16) being provided with an end section (16*b*) supporting a nozzle (14) that is provided with a nozzle part (14*a*) and a connecting part (14*b*), the connecting part of the nozzle being connected to the lower tube part end section, wherein the lower tube part (16) is arranged to be turned about 180° relative to the upper tube part (15) from a first turning position in which said end section (16*b*) is inclined a first angle (α) with respect to the floor to a second turning position in which the end section (16*b*) is inclined a second angle (β) with respect to the floor, said second angle being less than said first angle;

wherein the tube sections are generally straight and are connected to one another by at least on tubular bent segment (15*a*, 15*b*, 16*a*); and wherein the upper tube part (15) comprises a first bent segment (15*a*) and a second oppositely bent segment (15*b*), the second bent segment continuing into a lower tube section (15*e*), said lower tube section (15*e*) cooperating with an upper tube section (16*c*) of the lower tube part (16), said upper section (16*c*), via a bent segment (16*a*), continuing into said end section (16*b*).

5. A tube shaft according to claim 1, wherein said tube parts (15,16) cooperate to define locking means (18,22) for releasably fixing said upper and lower tube parts to one another in at least said first and second turning positions.

6. A tube shaft for a vacuum cleaner, said shaft (10) comprising an upper tube part (15) and a lower tube part (16) turnably connected to one another, each tube part comprising at least two tube sections (15*c*, 15*e*, 16*b*, 16*c*) that are inclined with respect to one another, the lower tube part (16) being provided with an end section (16*b*) supporting a nozzle (14) that is provided with a nozzle part (14*a*) and a connecting part (14*b*), the connecting part of the nozzle being connected to the lower tube part end section, wherein the lower tube part (16) is arranged to be turned about 180° relative to the upper tube part (15) from a first turning position in which said end section (16*b*) is inclined a first angle (α) with respect to the floor to a second turning position in which the end section (16*b*) is inclined a second angle (β) with respect to the floor, said second angle being less than said first angle;

wherein said tube parts (15, 16) cooperate to define locking means (18, 22) for releasably fixing said upper and lower tube parts to one another in at least said first and second turning positions; and wherein said lower tube part (16) and said nozzle (14) cooperate to define another locking means for releasably fixing said lower tube part and said nozzle to one another in at least two turning positions.

7. A tube shaft for a vacuum cleaner, said shaft (10) comprising an upper tube part (15) and a lower tube part (16) turnably connected to one another, each tube part comprising at least two tube sections (15*c*, 15*e*, 16*b*, 16*c*) that are inclined with respect to one another, the lower tube part (16) being provided with an end section (16*b*) supporting a nozzle (14) that is provided with a nozzle part (14*a*) and a connecting part (14*b*), the connecting part of the nozzle being connected to the lower tube part end section, wherein the lower tube part (16) is arranged to be turned about 180° relative to the upper tube part (15) from a first turning position in which said end section (16*b*) is inclined a first angle (α) with respect to the floor to a second turning position in which the end section (16*b*) is inclined a second angle (β) with respect to the floor, said second angle being less than said first angle;

wherein said lower tube part (16) and said nozzle (14) cooperate to define locking means for releasably fixing said lower tube part and said nozzle to one another in at least two turning positions.

8. A tube shaft according to claim 1, wherein the upper tube part includes an upper section (15*c*) which, in one of the turning positions, is generally in line with said end section (16*b*).

9. A tube shaft for a vacuum cleaner, said shaft (10) comprising an upper tube part (15) and a lower tube part (16) turnably connected to one another, each tube part comprising at least two tube sections (15*c*, 15*e*, 16*b*, 16*c*) that are inclined with respect to one another, the lower tube part (16) being provided with an end section (16*b*) supporting a nozzle (14) that is provided with a nozzle part (14*a*) and a connecting part (14*b*), the connecting part of the nozzle being connected to the lower tube part end section, wherein the lower tube part (16) is arranged to be turned about 180° relative to the upper tube part (15) from a first turning position in which said end section (16*b*) is inclined a first angle (α) with respect to the floor to a second turning position in which the end section (16*b*) is inclined a second angle (β) with respect to the floor, said second angle being less than said first angle;

wherein said tube parts (15, 16) cooperate to define locking means (18, 22) for releasably fixing said upper and lower tube parts to one another in at least said first and second turning positions; and wherein the locking means comprise a latching means (18, 20) arranged on one of the tube parts (15, 16), the latching means cooperating with openings (22) formed in cooperating tube sections of the tube parts.

10. A tube shaft according to claim 6, wherein the locking means comprise a latching means (18,20) arranged on one of the tube parts (15,16), the latching means cooperating with openings (22) formed in cooperating tube sections of the tube parts.

11. A tube shaft according to claim 7, wherein the locking means comprise a latching means (18,20) arranged on one of the lower tube part (16) and the nozzle (14), the latching means cooperating with openings formed in cooperating sections of the lower tube part and the nozzle.

12. A tube shaft according to claim 1, wherein, in the first turning position, at least two of said tube sections are axially aligned.

* * * * *